US005577712A

United States Patent [19]

White, Jr.

[11] Patent Number: 5,577,712

[45] Date of Patent: Nov. 26, 1996

[54] BARBED ROPE OR CORD FOR REPAIR OF BARBED WIRE FENCING

[76] Inventor: P. H. White, Jr., P.O. Box 155, 804 Sampson Ave., Dyersburg, Tenn. 38025-0155

[21] Appl. No.: 590,980

[22] Filed: Jan. 24, 1996

[51] Int. Cl.[6] ..... E04H 17/04

[52] U.S. Cl. ..... 256/7; 256/2

[58] Field of Search ..... 256/2–9; 140/67, 140/64, 72, 59, 58

[56] References Cited

U.S. PATENT DOCUMENTS

| | | | |
|---|---|---|---|
| 379,729 | 3/1888 | Rodden | 256/6 |
| 496,974 | 5/1893 | Guilleaume | 256/6 |
| 3,454,261 | 7/1969 | Nachazel | 256/2 |
| 3,550,911 | 12/1970 | Burton . | |
| 3,720,055 | 3/1973 | De Mestral et al. | 256/8 X |
| 4,182,382 | 1/1980 | Ingraham . | |
| 4,860,996 | 8/1989 | Robbins, III . | |
| 4,905,969 | 3/1990 | Kurschner et al. . | |
| 4,973,029 | 11/1990 | Robbins, III . | |
| 5,409,196 | 4/1995 | Specht | 256/54 |

*Primary Examiner*—Anthony Knight

*Attorney, Agent, or Firm*—Lowe, Price, LeBlanc & Becker

[57] ABSTRACT

A barbed rope or cord that can be carried for quick and easy barbed wire fence repair without the requirement of heavy tools or cutters for installation or cutting is disclosed. The rope or cord is a synthetic material, such as polyester, or a natural material such as cotton or hemp. The barbs are metal or made of other material capable of having sufficiently sharp ends to act as a deterrent against animals pressing against the barbed wire fence. The material from which the rope or cord is made is very flexible to allow the barbed cord to be wound onto itself into a ball or bundle for easy of carrying and storage. In use, a sufficient length of a barbed cord would be unwound from the bundle or ball, easily cut with a knife, and then strung on the fence, with opposite ends of the cut replacement material being easily tied to the fence post or loose ends of the barbed wire being repaired.

21 Claims, 2 Drawing Sheets

BARBED ROPE OR CORD FOR REPAIR OF BARBED WIRE FENCING

TECHNICAL FIELD

The present invention relates generally to barbed wire and, more particularly, to barbed flexible materials for repair of breaks in barbed wire fencing.

BACKGROUND ART

Barbed wire has been commonly used for many years to fence in land and to act as a deterrent against trespass not only by humans but by animals as well. Barbed wire fencing also has a preferred use to contain certain types of farm animals, such as cows, horses, sheep, etc., on a certain piece of property.

To make acceptable barbed wire, a plurality of metal barbs are attached to steel strand wire, or in some cases to a single line metal wire at longitudinally spaced intervals as the wire is fed through a conventionally constructed barbed wire machine. Such machines are constructed to wrap the barbs tightly around the metal wire. Sometimes, however, the metal wire itself may be coated with plastic to provide some degree of restraint against shifting of otherwise loose barbs, or it may be crimped at suitable intervals to ensure that no sliding of the barbs can take place.

The wire to which the barbs are attached to form barbed wire is typically steel and may have a diameter of about 1/10 inch. The barbed wire is customarily available in bale form wherein approximately 50 feet or more of barbed wire is coiled into a diameter measuring approximately 2 to 5 feet across, depending upon the length of the barbed wire within the bale.

During the initial installation of a barbed wire fence, it will be appreciated that many bales are necessary to construct what is often miles of fencing, wherein the barbed wire is unrolled from the fence, cut with heavy shears, and then stretched before it is finally secured between a pair of fence posts. Typically, two or more strands are secured along the height of the fence post at vertically spaced intervals from each other depending upon fence height.

In the event that it is necessary to repair a barbed wire fence, such repairs generally require no more than the replacement of a short single length of barbed wire that may be strung between two of the fence posts. Unfortunately, however, given the rigid nature of the steel barbed wire, such repairs often require that a bale or a part thereof be carried to the repair site, as well as heavy shears to cut the unrolled wire to the desired length and a heavy mallet with which to attach the replacement piece between the posts. In other words, virtually the same materials and tools used for the initial installation of the entire fence are necessary to repair even a short break in the fence.

It is accordingly one object of the present invention to quickly and easily repair a barbed wire fence.

Another object is to repair barbed wire fencing without requiring any cutting and installation tools other than a knife, such as a pocket knife.

Yet a further object is to repair barbed wire fence with a barbed material that can be close coiled or rolled onto itself into a tight ball or bundle, and is therefore capable of being easily and compactly stored and carried to the repair site.

DISCLOSURE OF THE INVENTION

In accordance with the teachings of the present invention, a barbed wire for preferred use in repair or replacement of other barbed wire within an existing barbed wire fence, comprises a rope or cord formed from a non-metallic material and barbs connected to said rope or cord. By the use of non-metallic rope or cord material, the rope or cord is sufficiently flexible so as to be wound onto itself into a tight ball or close coil system for ease of carrying and compact storage. At the repair site, a sufficient length of the rope or cord is unrolled from the ball and easily cut without the need for heavy and expensive cutting shears.

Substantially all of the barbs include at least one turn wrapped around the rope or cord. In the preferred embodiment, the rope or cord is made of a synthetic material, such as polyester. However, it will be understood that the rope or cord can also be made of a natural fiber material, such as cotton or hemp.

Although the barbs are preferably metal, the barbs may also be formed from a non-metallic material provided that they can be formed with sufficiently sharp ends to provide the necessary deterrent effect against animals pressing against the barbed wire fence.

The rope or cord can also be made of multi-strand fibers, or a single strand. The cord is typically a heavy thread or firm yarn made by tightly twisting together two or more threads or applied yarns. In the event that rope is used, the rope is preferably made of strands of natural or artificial fibers twisted or braided together.

In the preferred embodiment, the barbs are metal and are wrapped around the cord or rope with sufficient tightness to alter the cross section of the cross section of the cord or rope material relative to cross sectional areas of the cord located immediately adjacent the area supporting the barb. This achieves a crimping effect to enable the barb to resist rotation or longitudinal sliding movement relative to the underlying rope or cord.

In accordance with another aspect of the invention, a barbed wire comprises a rope or cord with barbs connected to it. The rope or cord is sufficiently flexible so as to be wound onto itself into a ball for ease of carrying and compact storage.

The flexibility of the rope or cord can be defined such that adjacent portions of the rope or cord may be folded onto and into intimate contact with each other by means of finger pressure, this intimate contact extending up to and including a bight formed therebetween also by finger pressure.

The rope or cord may also be selected from a material that is inherently capable of stretching at least 10% of its unstretched length without breaking. This material can also include a resilient material that may be wholly or partly formed from rubber.

A method of repairing a barbed wire fence constructed from metal wire is also disclosed. The method comprises the steps of transporting a repair barbed wire material in the form of a rope or cord formed from a non-metallic material with barbs connected to the rope or cord. A predetermined replacement length of this material is then cut with a knife. The replacement length is then attached to the fence.

These and further objects and advantages of the invention will become more apparent upon reference to the following description, drawings and claims.

BEST MODE FOR CARRYING OUT THE INVENTION

Figure 1:
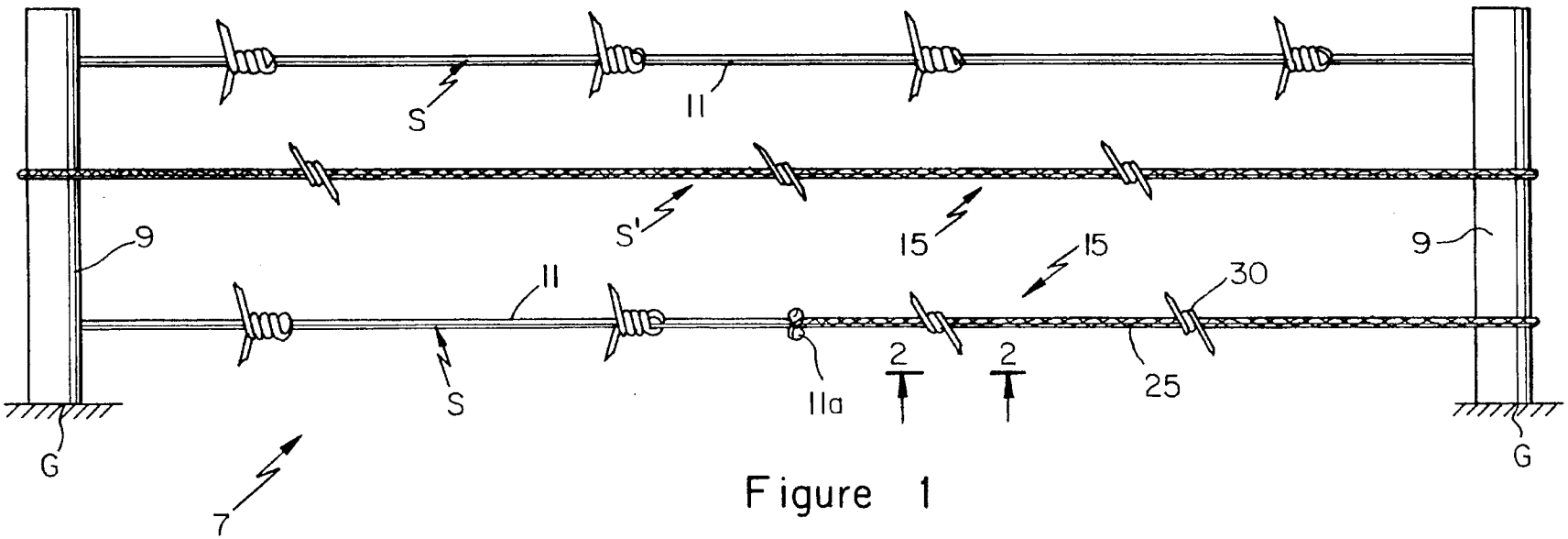
FIG. 1 is an elevational view of a barbed wire fence which has been repaired with a section of barbed rope or cord constructed in accordance with the teachings of the present invention.
Figure 4A:
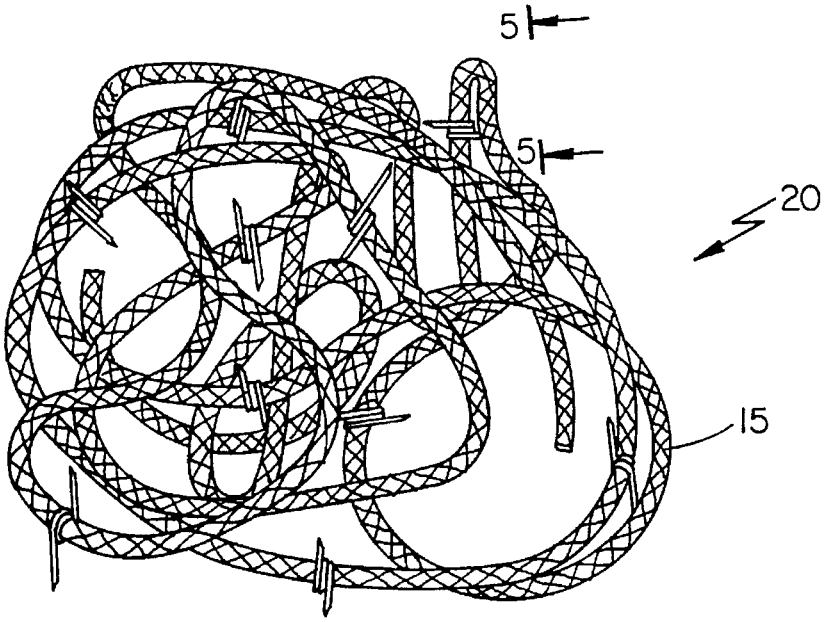
FIG. 4A is a perspective view of a ball of barbed rope or cord constructed in accordance with the present invention.
Figure 4B:
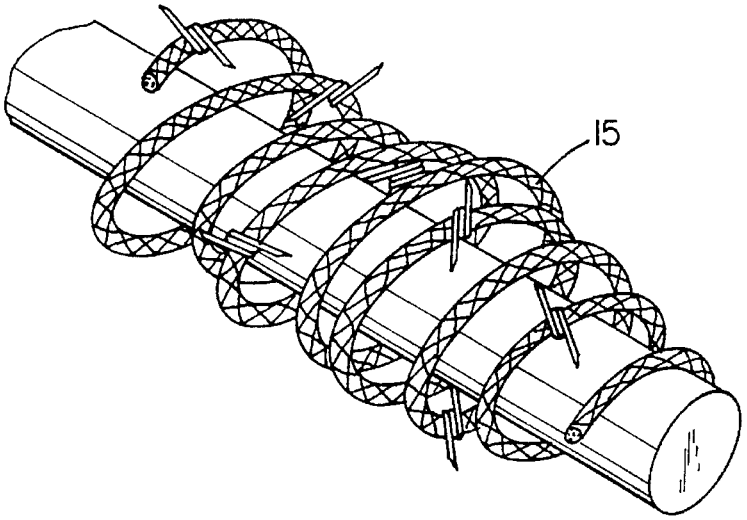
FIG. 4B is a perspective view of barbed rope or cord in accordance with the present invention as tightly rolled or coiled on a winding core.

FIG. 1 is an illustration of an elevational view of a barbed wire fence 7 which is typically comprised of pairs of fence posts 9 projecting upwardly from ground G at spaced intervals from each other, to which two or more strands S of conventional steel barbed wire 11 are attached to act as a deterrent against trespass. In the embodiment depicted in FIG. 1, the middle strand S' has broken or is missing and has therefore been replaced with barbed rope 15 in accordance with the present invention. The lower steel strand S has been partially repaired with another piece of barbed rope 15 of the invention. In accordance with the unique features discussed more fully below, barbed rope 15 is sufficiently flexible so that a length thereof (e.g., 10–20 feet) can be wound onto itself into a tight ball 20 (best depicted in FIG. 4A) or a close coil system (as best depicted in FIG. 4B) for ease of carrying and compact storage. At the repair site, a sufficient length of the rope or cord 15 is unrolled from the ball 20 and easily cut (e.g., with a pocket knife) without the need for heavy and expensive cutting shears. With reference to FIG. 1, the cut length of barbed rope 15 can then be stretched and tied to one or more fence posts 9, or nailed to the fence post, or otherwise secured to existing steel barbed wire strand 11 to complete the broken strand.

More specifically, barbed rope 15 is comprised of a flexible rope or cord material 25 which can be made of a synthetic material, such as polyester, or a natural fiber material, such as cotton or hemp. Preferably, but not necessarily, this flexible rope or cord 25 is made of multi-strand fibers or a single strand. The cord 25 is typically a heavy thread or firm yarn made by tightly twisting together two or more threads or applied yarns. In the event that rope is used, the rope is preferably made of strands of natural or artificial fibers twisted or braided together.

Figure 5:
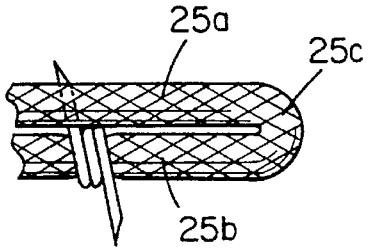
FIG. 5 is a sectional view taken along the line 5—5 of FIG. 4 to depict the flexible nature of the barbed rope or cord.

In the preferred embodiment depicted in the drawings, the cord 25 is braided along its entire length and preferably has a diameter of about ⅛–3/16 inch. It has been found that this diameter provides for sufficient strength to enable barbed rope 15 to perform its function while being sufficiently flexible so that the material can be wound onto itself into the ball 20 (FIG. 4) for ease of carrying and compact storage. As a means for defining flexibility, a preferred material from which rope or cord 25 may be made has sufficient flexibility such that adjacent portions 25*a* and 25*b* of a piece of the rope or cord may be folded onto and into intimate contact with each other by means of finger pressure, this intimate contact extending up to and including a bight 25*c* formed therebetween also by finger pressure. This relationship is best depicted in FIG. 5.

Figure 3:
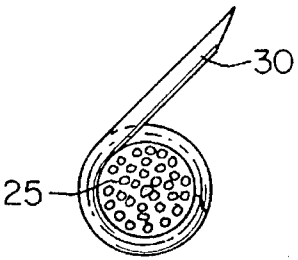
FIG. 3 is a sectional view taken along the line 3—3 of FIG. 2.
Figure 2:
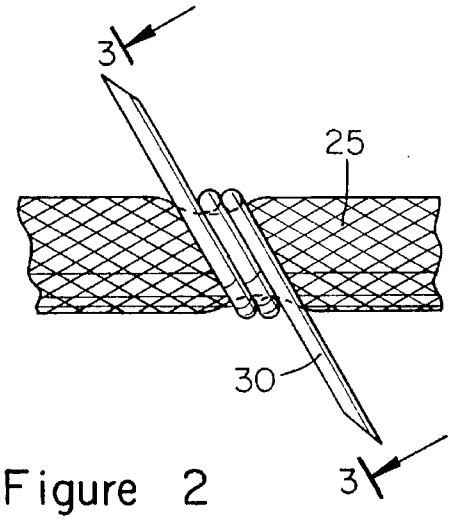
FIG. 2 is a sectional view taken along the line 2—2 of FIG. 1, depicting a portion of the barbed rope or cord to which one of the barbs is attached, drawn on a slightly enlarged scale.

In the preferred embodiment, a plurality of barbs 30 are wrapped around the cord or rope 25 with sufficient tightness to alter the cross-section of the cord or rope material relative to cross-sectional areas of the cord located immediately adjacent the area supporting the barb. This relationship is best depicted in FIGS. 2 and 3. This achieves a crimping effect to enable the barb 30 to resist rotation or longitudinal sliding movement relative to the underlying rope or cord 25.

Although the individual barbs 30 are preferably made of metal, it is also possible to utilize a non-metallic material provided that opposite ends thereof can be made sufficiently sharp to enable such barbs to perform their intended function. In addition, barbs 30 can have other configurations known in the art.

The rope or cord 25 is preferably selected from a material that is capable of stretch at least 10% of its unstretched length without breaking. This material preferably is a resilient material that may be wholly or partly formed from rubber. The ability of barbed rope or cord 15 to stretch, unlike conventional steel barb wire, constitutes another highly desirable feature of the invention since it enables a workman to stretch the cord 25 to a desired tension during installation.

A method of repairing a barbed wire fence 7 constructed from metal wire 11 comprises the steps of transporting a repair barb wire material in the form of a rope or cord 15 to a work site. A predetermined replacement length of this material 15 is then cut with a knife. The replacement length is then attached to the fence posts 9 or to existing steel wire 11 (through a knot 11*a* or otherwise) as depicted in FIG. 1.

Of course, it is also within the scope of this invention to utilize barbed rope or cord 15 for the installation of complete barbed wire fences and not merely to replace or repair broken steel barbed wire 11. Other uses of cord or rope 15 are also possible as will occur to those skilled in the art based upon a review of this specification.

The invention has been described herein with reference to certain preferred embodiments. However, as obvious variations thereon will become apparent to those skilled in the art, the invention is not to be considered as limited thereto.

I claim:

1. A barbed rope or cord, comprising:

(a) a rope or cord formed from a non-metallic material; and (b) barbs connected to said rope or cord.

2. The barbed rope or cord of claim 1, wherein said barbs substantially each include at least one turn wrapped around said rope or cord.

3. The barbed rope or cord of claim 1, wherein said rope or cord is made of a synthetic material.

4. The barbed rope or cord of claim 3, wherein said synthetic material is polyester.

5. The barbed rope or cord of claim 1, wherein said rope or cord is made of a natural fiber material.

6. The barbed rope or cord of claim 5, wherein said natural fiber material is cotton or hemp.

7. The barbed rope or cord of claim 1, wherein said barbs are metal.

8. The barbed rope or cord of claim 1, wherein said barbs are non-metallic material.

9. The barbed rope or cord of claim 1, wherein said rope or cord is sufficiently flexible so as to be wound onto itself into a ball for ease of carrying and compact storage.

10. The barbed rope or cord of claim 1, wherein said rope or cord is made of multi-strand fibers.

11. The barbed rope or cord of claim 1, wherein said rope or cord is single-strand.

12. The barbed rope or cord of claim 1, wherein said cord is a heavy thread or firm yarn made by tightly twisting together two or more threads or plied yarns.

13. The barbed rope or cord of claim 12, wherein said rope is made of strands of natural or artificial fibers twisted or braided together.

14. The barbed rope or cord of claim 12, wherein said barbs are metal and are tightly wrapped around the cord with sufficient tightness to alter the cross-section of the cord relative to cross-sectional areas of the cord located immediately adjacent the area supporting the barb.

15. The barbed rope or cord of claim 1, wherein said rope or cord has a diameter of about 0.1–0.5 inch.

16. A barbed rope or cord, comprising:

(a) a rope or cord;

(b) barbs connected to said rope or cord; and (c) wherein said rope or cord is sufficiently flexible so as to be wound onto itself into a ball for ease of carrying and compact storage.

17. The barbed rope or cord of claim 16, wherein the flexibility of said rope or cord is such that adjacent portions of said rope or cord may be folded onto and into intimate contact with each other by means of finger pressure, said intimate contact extending up and including a bight therebetween by finger pressure.

18. The barbed rope or cord of claim 16, wherein said rope or cord is a material that is capable of stretching at least ten percent of its unstretched length without breaking.

19. The barbed rope or cord of claim 16, wherein said rope or cord includes rubber.

20. A method of repairing a barbed wire fence constructed from metal wire, comprising the steps of:

(a) transporting to a repair site a repair barbed wire material in the form of a barbed rope or cord comprising a rope or cord formed from a non-metallic material with barbs connected to said rope or cord;

(b) cutting a predetermined repair length of said non-metallic material with a knife; and (c) attaching said replacement length to mend the fence.

21. The method of claim 20, wherein the non-metallic replacement material is sufficiently pliable so that opposite ends of said replacement length may be respectively tied to adjacent fence posts or to loose ends of existing barbed metal wire material within the fence.

* * * * *